US005083163A

United States Patent [19]

Brown et al.

[11] Patent Number: 5,083,163

[45] Date of Patent: Jan. 21, 1992

[54] PHOTOCONDUCTOR RESETTING FOLLOWING MULTIPLE CHARGE IMAGES

[75] Inventors: David E. Brown, St. Paul, Minn.; Gregory L. Zwadlo, Ellsworth, Wis.

[73] Assignee: Minnesota Mining & Manufacturing Company, Saint Paul, Minn.

[21] Appl. No.: 552,698

[22] Filed: Jul. 16, 1990

[51] Int. Cl.[5] ..... G03G 15/02

[52] U.S. Cl. ..... 355/219; 355/218; 430/54; 430/58

[58] Field of Search ..... 355/218-227, 355/326, 327; 430/31, 54, 55, 58, 100, 126

[56] References Cited

U.S. PATENT DOCUMENTS

| | | | |
|---|---|---|---|
| 4,035,750 | 7/1977 | Staudenmayer et al. . | |
| 4,244,646 | 1/1981 | Bayer et al. . | |
| 4,286,032 | 8/1981 | Ito et al. | 430/55 |
| 4,337,305 | 6/1982 | Beretta et al. | 430/82 |
| 4,340,656 | 7/1982 | Seino et al. | 430/48 |
| 4,356,244 | 10/1982 | Leichter et al. | 430/82 |
| 4,357,405 | 11/1982 | Leichter et al. | 430/58 |
| 4,361,637 | 11/1982 | Stofko, Jr. et al. | 430/58 |
| 4,367,274 | 1/1983 | Leichter et al. | 430/58 |
| 4,408,865 | 10/1983 | Camis et al. . | |
| 4,621,920 | 11/1986 | Takahashi . | |
| 4,636,060 | 1/1987 | DeSchamphelaere et al. . | |
| 4,669,854 | 6/1987 | Ichikawa et al. . | |
| 4,728,983 | 3/1988 | Zwadlo et al. . | |
| 4,804,602 | 2/1989 | Buettner et al. | 430/42 |
| 4,820,846 | 4/1989 | Brown et al. | 548/420 |
| 4,827,306 | 5/1989 | Tsujimoto et al. | 355/210 X |
| 4,853,310 | 8/1989 | Brown et al. | 430/83 |
| 4,891,287 | 1/1990 | Toyoshi et al. | 355/218 X |
| 4,897,330 | 1/1990 | Shoji et al. | 430/54 |
| 4,959,695 | 9/1990 | Nishimura et al. | 355/327 |

*Primary Examiner*—A. T. Grimley
*Assistant Examiner*—T. Dang
*Attorney, Agent, or Firm*—Kinney & Lange

[57] ABSTRACT

An electrical charging system for repeatedly electrically charging a photoconductor layer on an electrical conductor through charging that photoconductor layer, selectively discharging it, providing toner on the layer, and removing the charge image in the photoconductor for each of as many toners as desired for forming a final printed image, followed by using a removal radiation of a shorter wavelength on the photoconductor to avoid long term changes in the photoconductor. A further charging cycle may be used before the next printed image operation begins.

21 Claims, 3 Drawing Sheets

PHOTOCONDUCTOR RESETTING FOLLOWING MULTIPLE CHARGE IMAGES

BACKGROUND OF THE INVENTION

The present invention relates to electrophotographic reproduction systems and, more particularly, to color electrophotographic reproduction systems.

Electrophotographic reproduction equipment is finding increasing use. This is particularly so for full color reproductions which can be provided with very high quality using electrophotographic methods. Such methods are used for both copiers and for very much higher resolution color proofing printers.

An example of such a system is shown in FIG. 1 in a highly schematic form. The electrophotographic process is practiced on the outer cylindrical surface of a drum, 10, that is selectively rotated by a stepper motor, 11, under the direction of a control system, 12. Drum 10 is formed of a metal core, 13, which can rotate in journals supported on a frame, not shown, about a rotation axis that is essentially its axis of symmetry with respect to its cylindrical outer surface. The cylindrical outer surface portion of metal core 13 has a plastic layer, 14, as a substrate wrapped therearound. An electrically conductive surface layer, 15, is provided on plastic layer 14, and an organic photoconductor, 16, is coated on that conductive surface which is electrically connected to ground through metal core 13. In addition, the top surface of the photoconductor layer may be coated with a silicon polymer, approximately 50 nm thick, the purpose of which is to assist in the efficient transfer of toner materials deposited thereon.

Organic photoconductor 16 is typically formed through providing an organic photoconductor compound and a dye sensitizing material together in a polymeric binder material which binding material will typically form an electrically insulating film. One typical p-type photoconductor compound for such use is Bis-(N-ethylbenzo-1,2-carbazolyl)phenylmethane. A typical sensitizing dye material, used in association with this photoconductor compound to increase the sensitivity to electromagnetic radiation in the near infrared portion of the electromagnetic spectrum, is taught in U.S. Pat. No. 4,853,310 entitled "Triiolide Salts of Cyanine Dyes Suitable for Sensitization of Photoconductive Systems" to Brown et al which is assigned to the same assignee as is the present application, and which is hereby incorporated herein by reference. Other teachings of alternative, or supplementary, materials for use with organic photoconductor layer 16 are taught in U.S. Pat. Nos. 4,337,305 entitled "Sensitized Organic Electron Donor Compounds" to Beretta et al, 4,356,244 entitled "Quinoxaline Cyanine Dye Sensitized Organic Electron Donor Compounds" to Leichter et al, 4,357,405 entitled "Fluorinated Dye Sensitized Organic Electron Donor Compound" to Leichter et al, 4,361,637 entitled "Electron Bis-Benzocarbazole Donor Compounds and Photoconductive Charge Transport Materials" to Stofko, Jr. et al, 4,367,274 entitled "Sensitized Organic Electron Donor Bis-Benzocarbazole Compounds"]to Leichter et al, and 4,820,846 entitled "Triarlymethane Compounds, Their Preparation and Use as Photoconductive Systems" to Brown et al, all of which are assigned to the same assignee as is the present application, and all of which are hereby incorporated herein by reference.

FIG. 2 shows the electromagnetic radiation absorbance characteristic of a typical photoconductor layer formed of the kinds of materials just described. As can be seen, the absorbance is relatively low in the visible portion of the electromagnetic radiation spectrum, and relatively high in the near infrared portion of that spectrum. The absorbance is also very high in the ultraviolet portion of the spectrum so that, clearly, ultraviolet radiation will not penetrate very far into photoconductor layer 16.

FIG. 3 shows the photoconductive response on a relative basis of a typical photoconductive layer formed of these materials. Clearly, substantial absorbance in a photoconductor layer formed of these materials also leads to a substantial photoconductive response in the material of photoconductor layer 16.

The circumference of the cylindrical surface of drum 10 having this photoconductor layer therein has been selected to be 846.667 mm in this example. A typical surface velocity of the exposed surface of drum 10 during a reproduction cycle would be 5 mm/sec. Stepper motor 11 has been chosen in this example to provide 200,000 steps per a complete revolution of drum 10.

In the electrophotographic reproduction process, organic photoconductor layer 16 is charged to a surface potential at its exposed surface of from typically 200 V to 450 V with respect to ground. Selected portions of that surface are thereafter discharged by a modulated, scanning laser beam to a lower potential at those locations encountering sufficient beam intensity under the modulation signal to result in forming a desired electrostatic charge pattern, or potential pattern, on that surface. This pattern is provided in accord with a color separation signal underlying the modulation signal which specifies the desired locations of a constituent color in a desired resulting printed image which is typically formed of three or four such colors, although there may be more colors used to achieve certain desired effects. The discharged areas remaining in layer 16 are then allowed to attract a selected toner having a desired constituent color, this attracted toner subsequently being transferred from the surface of drum 10 along with other color toners to the surface of the medium on which the printing is to occur to form a printed image.

In more detail, an electrifier, 17, such as a grid-controlled direct current corona discharge unit or scorotron, supplies, quite uniformly, a positive electric charge to adjacent portions of the outer surface portion of photoconductor layer 16 as they pass thereby during rotation of drum 10 which causes the surface past electrifier 17 to reach the desired initial surface potential, which is in the range indicated above, prior to its reaching the region of intersection with the scanning laser beam. The scanning laser beam, modulated effectively by a corresponding color separation signal to provide the associated electric charge pattern on the outer surface of photoconductor layer 16 by selectively discharging that surface, does so successively for each of toner units 19.

In the locations intersected by the laser beam at a sufficient intensity, holes as positive charge carriers are generated in photoconductor layer 16 with subsequent movement of the generated holes through layer 16 towards conductive surface layer 15 which is relatively negative. The electrons in the charge carrier pairs from which the holes are obtained, however, are bound at the corresponding charge generation sites. In effect, the result is equivalent to transporting negative charge closer to the outer surface of photoconductor layer 16 at those locations where the scanning laser beam has impinged with sufficient intensity to thereby result in a decrease in the surface potential of those portions of layer 16. Thus, the resulting pattern of high and low surface potentials across the outer surface of photoconductor layer 16 forms the electrostatic image from the corresponding color separation signal which can then be developed into a visible image on that surface by having charged liquid toner come into contact therewith.

A toning developer arrangement, 18, contains six identical units, 19, each containing an alternative one of the four constituent color liquid toners that might each be used to form a corresponding subimage in route to forming a complete color printed image, plus two other alternative colored toners which may also be used for any special effects desired. The four colors typically are black, cyan, magenta and yellow liquid toners. Portions of the electromagnetic radiation absorbance characteristics for the cyan, magenta and yellow liquid toners used typically in the system of FIG. 1 are shown in FIG. 4. As can be seen there, the absorbance of electromagnetic radiation in the near infrared region of the spectrum, and for wavelengths beyond, is quite low for these toners. As a result, the scanning laser beam mentioned above is chosen to have its wavelength distribution to be primarily in the near infrared region of the spectrum so that this beam can pass through any toner which is on the outer surface of photoconductor layer 16 to discharge the this layer below that portion of that surface impinged upon by the beam despite the presence of one or more toners thereon.

In each unit 19, there are pumping means to supply the toner to the surface of a moving band, 20, provided in each, this band being capable of being rotated across the outer surface of drum 10 parallel to the rotation axis thereof. A selected toner unit 19 has its band 20 charged to a voltage sufficiently above the discharge potential in laser beam exposed portions of photoconductor layer 16 to ensure adequate density of deposited toner in these laser exposed areas, but sufficiently below the initial charging potential of layer 16 to avoid unwanted toner deposits in the non-exposed regions. A vacuum provision arrangement is provided in each toner unit 19 on the opposite side of the band opposite the pump means to remove excess liquid toner. A motor arrangement, 21, is controlled by control unit 12 to position a selected one of toner units 19 so that a surface of the band 20 therein is typically brought to within a few hundred microns of photoconductor layer 16 on drum 10 to thereby permit constituents of the toner in that unit to be attracted to corresponding portions of this outer surface of photoconductor layer 16.

As indicated above, the selective impingement of the scanning laser beam with sufficient intensity at selected locations on the outer surface of photoconductor layer 16 results in a pattern of high and low surface potentials on this outer surface of layer 16 which can be developed into a visible image by the attraction of charged liquid toner selectively thereto, as described above. The potential value on band 20 is controlled so that positively charged, colored toner particles travel to only the portions of the outer surface of photoconductor layer 16 which have had the laser beam impinge thereon with sufficient intensity to discharge those portions to a surface potential, typically 40 to 70 V, which is well below that of the remaining portions of that outer surface which were typically initially charged by electrifier 17 to values in the range of 200 to 450 V. The electric field within the gap between the surface of photoconductor layer 16 and the band 20 induces disassociation of the toner material into its positively charged, colored particles and negatively charged, colorless, counter-ions.

These negatively charged colorless particles from the liquid toner, attracted to the surface portions of photoconductor layer 16 not discharged significantly by the laser beam impinging thereon, decrease the electric field within the photoconductor layer 16 below these particles. On the other hand, the positively charged colored toner particles lead to an increasing electric field in the portions of photoconductor layer 16 thereunder. In addition, there are the trapped negative charges within the bulk of photoconductor layer 16 in those regions beneath the colored toner particles which give the result of a non-uniform distribution of the electric field in such regions.

Thus, in summary, an initial pattern of high and low surface potentials is established on the outer surface of photoconductor layer 16 followed by a corresponding toner deposition step, and then a new such pattern is provided on photoconductor 16 under the previous toner, or toners, each time there is a completion of the deposition of the toner for the previous charge pattern until the final toner to be used has been deposited on the outer surface of layer 16. Each of the corresponding toners attracted to its corresponding charge pattern is deposited as a subimage and accumulated on the outer surface of photoconductor layer 16 to form the complete toner image. Each of the subimages must be kept sufficiently well registered with respect to the others to obtain a clear, complete toner image.

This complete toner image is subsequently transferred onto an intermediate medium formed by a coated polyester web, 22, which coating contains a thermally sensitive adhesive layer and a release/protective layer. Web 22 is shown in FIG. 1 forced against layer 16 on drum 10 by a heated roller, 23, which results in a transfer of accumulated toner on photoconductor layer 16 to web 22 through being picked up by the adhesive layer therein. A later step results in transferring the accumulated toner, the adhesive layer and parts of the release/protective layer from web 22 onto the medium on which printing is to occur, such as paper, to thereby provide a halftone printing result using up to six colors.

Providing the laser beam described above is a laser electromagnetic radiation source arrangement, 24, which is under the direction of control unit 12, to selectively discharge the outer surface of photoconductor 16 in drum 10. This beam, as indicated above, is modulated by control unit 12 using such corresponding color separation signals as are obtained from a memory, 25. Laser beam source 24 correspondingly supplies the modulated laser beam, 26, having a nominal wavelength of 833 nm (near infrared) through an optical beam conditioning unit, 27, to impinge on an eightfaceted, rotating polygon mirror arrangement, 28, which is rotated by a motor, 29, again operated by control unit 12. Laser beam 26 is reflected from successive facets of rotating polygon 28 to then pass through further processing optics, 30, so as to repeatedly scan from left to right across the portion of the cylindrical surface of photoconductor 16 and drum 10 that is rotated thereunder.

Note also that there remains some carrier liquid from the toner on the outer surface of photoconductor layer 16 after the charged portions thereof have been attracted to corresponding locations on that surface. Such excess liquid from the liquid toner is removed from the outer surface of photoconductor layer 16 after each toner has been attracted thereto through having each surface portion pass under a heated air stream provided by a dryer, 31, in FIG. 1.

Before a subsequent toner can be attracted to the outer surface of photoconductor layer 16 to form a new toner subimage after completion of the toner subimage of a previously used toner, differences in electric fields in photoconductor layer 16 and in charge distributions therein which, as mentioned above, occur between those portions of this layer which have been discharged by the laser beam impinging thereon with sufficient intensity, and those portions which have not been so subjected to the laser beam, must be eliminated or nearly eliminated Otherwise, vestiges of the charge/discharge pattern from the previous toner subimage will appear in the charge/discharge pattern of the following subimage. In other words, the electrostatic image established by the scanning laser beam for one toner must be "erased" before a subsequent electrostatic image can be formed for the following toner that is substantially free of any interfering effects lingering from the previous electrostatic image. Further, any permanent changes in the material of photoconductor layer 16 must be avoided so that vestiges of one complete toner image do not appear in any subsequent complete toner image. Further, these effects must be overcome without an undue delay between the finishing of one complete toner image and the next. Thus, there is a desire to have the system of FIG. 1 operate avoiding any such defective completed toner images and without the inconvenience of undue delay.

SUMMARY OF THE INVENTION

The present invention provides for an electrostatic image removal system which can repeatably set surface potentials on an outer surface of a photoconductor layer in a drum rotatable about an axis before and after a discharge electromagnetic radiation beam provides an electrostatic image on the photoconductor layer outer surface for each of the toners used in providing a complete toner image on that outer surface. This outer surface is charged substantially uniformly as the drum rotates with a discharge electromagnetic radiation beam directed onto the photoconductor layer outer surface as charged to thereby discharge that surface at selected locations. A first toner is provided at the photoconductor layer outer surface with portions of it remaining at locations determined by the discharge electromagnetic radiation beam. First erasure electromagnetic radiation is provided on the photoconductor layer outer surface at locations free of the first toner and at locations where the first toner is present, as the first toner is capable of transmitting therethrough a substantial portion of the first erasure electromagnetic radiation. The first toner being on the surface of photoconductor layer, and perhaps other toners provided thereon in the same manner as the first toner, are then transferred substantially to a transfer means from the photoconductor layer outer surface. Termination erasure electromagnetic radiation is then directed onto the outer surface of the photoconductor layer, the termination erasure electromagnetic radiation having wavelengths in a termination spectral distribution which are shorter than those in the spectral distribution of the first erasure electromagnetic radiation.

DETAILED DESCRIPTION OF THE PREFERRED EMBODIMENTS

Figure 1:
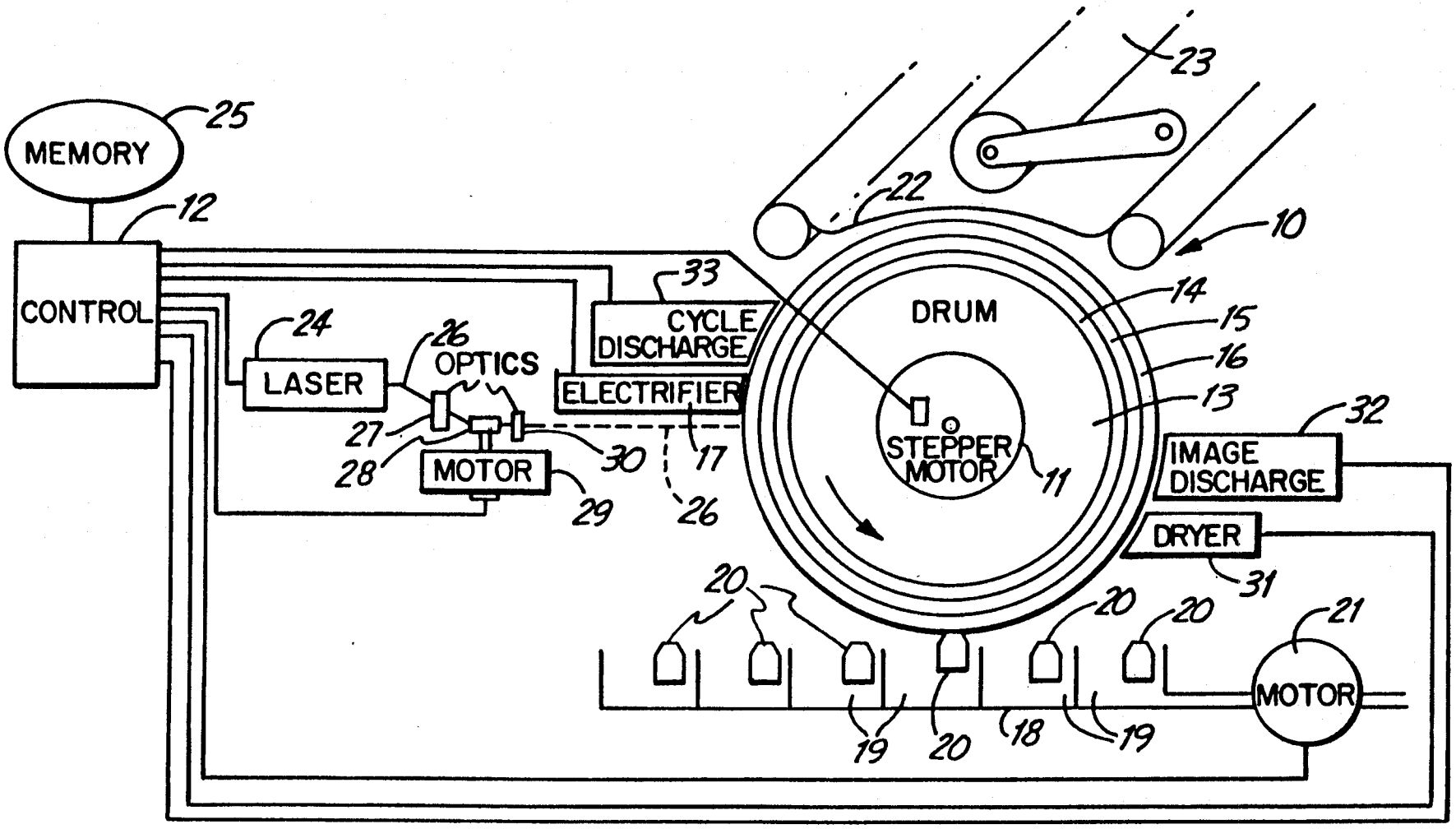
FIG. 1 shows a system in which the present invention is to be employed.
Figure 4:
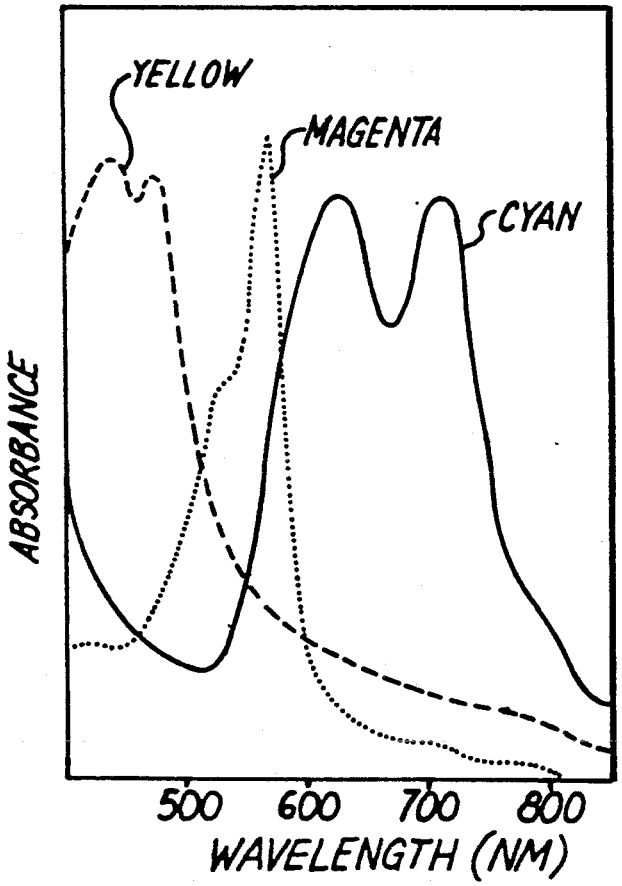
FIG. 4 shows a graph of a property of a material used in the system of FIG. 1.

In the system of FIG. 1, the electrostatic images formed by laser arrangement 24 under the direction of control unit 12, one for each of the toners used in forming a complete toner image on the outer surface of photoconductor layer 16, are each eliminated or "erased" by an image discharge means, 32, after the corresponding toner subimage has been formed on that surface. Image discharge means 32 is formed of a series of light-emitting diodes positioned along a line substantially parallel to the axis of rotation of drum 10 and separated by about 10 mm from the outer surface of photoconductor layer 16. The light-emitting diodes in image discharge means 32 emit electromagnetic radiation more or less centered about a wavelength of 840 nm, which is in the near infrared and substantially outside the strong absorption portions of the absorption characteristics of cyan, magenta and yellow toners as shown in FIG. 4.

Figure 2:
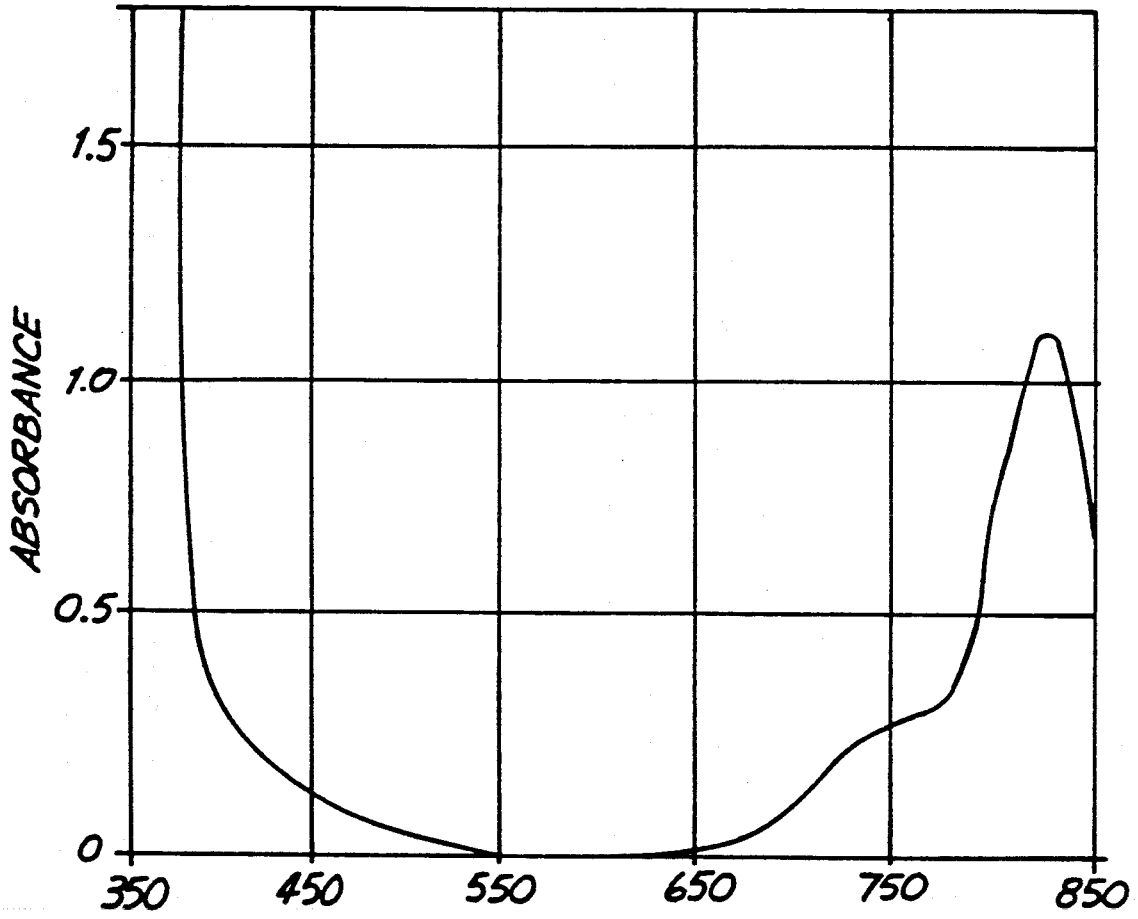
FIG. 2 shows a graph of a property of a material used in the system of FIG. 1.

This same light-emitting diode wavelength, on the other hand, is sufficiently close to the near infrared absorption peak of photoconductive layer 16 as shown in FIG. 2 to assure efficient discharging of the outer surface thereof to cause that surface potential to drop to between 0 and 40 V with respect to ground. Thus, this wavelength is also close to that of the radiation in laser beam 26 in laser arrangement 24 which also must efficiently discharge selected portions of photoconductor layer 16 to provide an electrostatic image therein. Image discharge means 32 could also be formed from light sources having a broader distribution of wavelengths than do light-emitting diodes so long as they provide a substantial part of their output energy in the near infrared region being considered here.

During illumination of photoconductor layer 16 by image discharge means 32, charge carrier pairs are generated in that layer relatively near the outer surface thereof so that holes again traverse the thickness of that layer to conductive layer 15. The immobility of the electrons in the charge generation pair from which these holes are obtained, along with this movement of those holes, has effectively the same result as a movement of negative charge toward the outer surface. Thus, there is a consequent reduction in, and so an equalization of, surface potentials between the regions therein which received significant energy from the laser sufficient to cause discharging thereof, and those regions which did not and so were not discharged.

Upon completion of (a) the selective attraction of the first toner on the outer surface of photoconductor layer 16 to form a first subimage thereon, and of the subsequent discharge of (b) the electrostatic image therebelow during one revolution of drum 10, the same process is repeated for the toner selected for the next toner subimage on the photoconductor layer surface during the next complete rotation of drum 10. That is, electrifier 17 again deposits positive charge on the outer surface of photoconductor layer 16 to bring it to a surface potential of around 400 V. Photoconductor layer 16 is then selectively discharged by infrared laser beam 26 impinging on selected portions thereof, including those already covered by the first toner colored particles which absorb little of beam 26. Thus, beam 26 provided by laser arrangement 24 forms a second electrostatic image corresponding to this second toner based on a corresponding color separation signal obtained by control 12 from memory 25.

A different unit 19 with a different colored toner has its band 20 brought to the immediate vicinity of the outer surface of photoconductor layer 16 by motor 21 under the direction of control unit 12 so that the positively charged toner particles are attracted to those portions of the surface of layer 16 (or to the surface of the first toner particles already thereon) which portions have been discharged by sufficient energy from beam 26 having been previously provided there by laser arrangement 24. The negatively charged colorless parts in the toner liquid are attracted to the other portions of the outer surface of layer 16 (or to the surface of the first toner particles already there). Again, image discharge means 32 with its light emitting diodes discharges layer 16 by directing infrared energy thereon, including on those portions under the first and second toners or both, so that the surface potential thereof drops to a voltage in the range of 0 to 40 V.

The repetitions of this process for each roll of drum 10 continue until the number of different colored toner subimages desired have been provided on the outer surface of photoconductor layer 16 of drum 10. Thereafter, the transfer of the completed toner image is made to coated polyester web 22 in the manner described above.

The formation of the complete toner image through the stacked series of toner subimages sequentially provided on the outer surface of photoconductor layer 16, and the transfer of that completed toner image to web 22 completes the steps necessary for providing a final printed image from this transferred result. Thereafter, some additional actions occur in the system of FIG. 1 to make it ready for providing another printed image when directed by its operator through control unit 12 to do so. The first of these readying steps is to remove trapped negative charges within the bulk of photoconductor layer 16.

Figure 3:
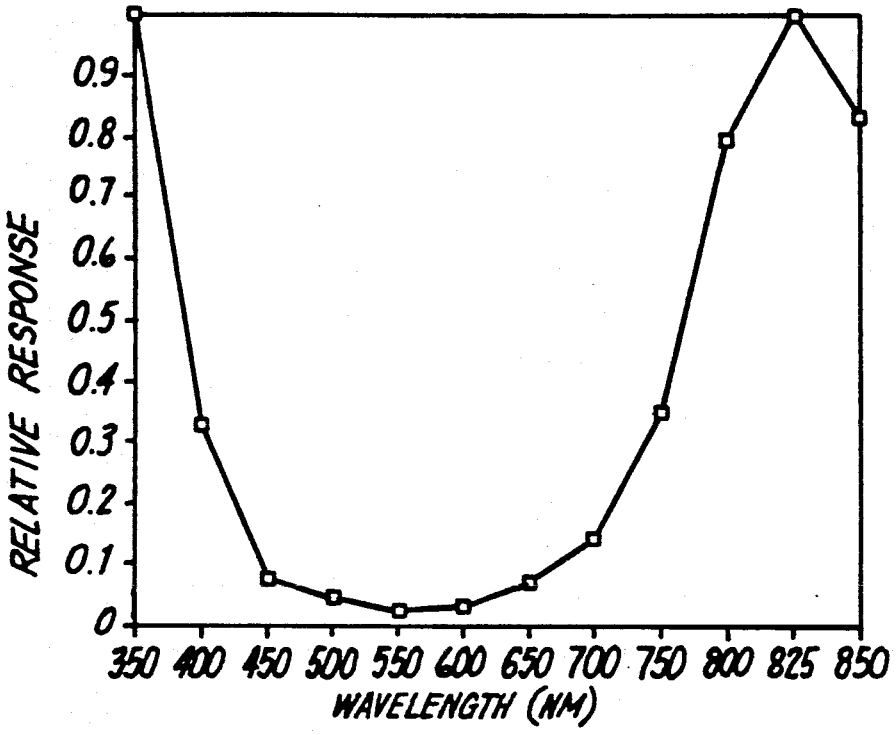
FIG. 3 shows a graph of a property of a material used in the system of FIG. 1.

This trapped charge removal is accomplished through use of a cycle discharge means, 33, as shown in FIG. 1. Cycle discharge means 33 is a source of electromagnetic radiation having wavelengths in the near ultraviolet portion of the electromagnetic spectrum with its peak wavelength at approximately 360 nm, this radiation being on the opposite side of the visible spectrum from the infrared radiation supplied by laser arrangement 24 and by image discharge means 32. This more energetic electromagnetic radiation from cycle discharge means 33 penetrates very little below the outer surface of photoconductor layer 16 because of its being so quickly absorbed by that layer as shown by the absorbance characteristic of that layer in FIG. 2. Further, since the photoconductive response is also relatively high, i.e. charge generation is very effective in photoconductive layer 16 at this wavelength as shown in the relative response characteristic of FIG. 3, a large quantity of mobile hole charge carriers is generated very near the outer surface of photoconductor layer 16. A substantial fraction of them are then swept through almost the entirety of the thickness of that layer so that the mobile holes neutralize the trapped charges scattered throughout the thickness of that layer through recombination with such trapped negative charges. Omission of this step after the formation of a complete toner image and its transfer can lead to permanent changes in repeatedly charged and laser discharged portions of photoconductor layer 16 so as to establish therein "memory" effects. These effects lead to vestiges of previously formed complete toner images showing up in subsequently formed complete toner images and so in the final printed image made therefrom.

Cycle discharge means 33 is positioned so that the ultraviolet lamp therein is approximately 1.0 cm from the outer surface of photoconductor layer 16, and this exposure occurs through a slit aperture parallel to the rotation axis of drum 10 which extends across the entirety of layer 16 and provides a 5.0 mm wide opening. The ultraviolet radiation passes through this opening and an optional neutral density filter to substantially uniformly provide ultraviolet radiation of 0.05 to 2.0 $mW/cm^2$ on the portion of the outer surface of layer 16 illuminated thereby. This value is chosen to neutralize the bulk trapped charges while avoiding excess exposure which would lead to generation of too many hole carriers with relatively long lifetimes which has the consequence of prolonging the dark adaptation period of photoconductor layer 16 necessary for eliminating such excess hole carriers.

The intensities chosen for the radiation provided by both image discharge means 32 and cycle discharge means 33 are dependent on the type of material used in photoconductor layer 16, the rotation speed of drum 10, the separations between these radiation sources and the outer surface of layer 16, the extent of the effective apertures used therewith in controlling the geometrical extent of the portion of the surface of layer 16 illuminated thereby, and the like. Thus, some adjustment in the intensities used, or the apertures, or other variables is usually needed to adapt the sources for proper operation in a particular system of the type in FIG. 1.

Even with such adjustments, the provision of the ultraviolet radiation on the outer surface of photoconductor layer 16 to neutralize bulk trapped charges affects the dark condition surface potential decay rate. This results in a subsequent decrease in surface potential after a subsequent charging of the outer surface of photoconductor layer 16 by electrifier 17 in beginning another formation of a complete toner image even though the charging conditions using electrifier 17 remain unchanged. A probable reason for this is the fact that the ultraviolet radiation in generating mobile hole charge carriers continues to do so until terminated so that some mobile hole carriers will leave behind unneutralized trapped negative charges. These trapped negative charges again effectively reduce the surface potential, and this effect can persist for several minutes after the termination of the inpingement of ultraviolet radiation on the outer surface of layer 16. In these circumstances, the operator is either forced to wait for a substantial amount of time before beginning formation of a subsequent toner image, or some further step must be taken to ready photoconductor layer 16 to reduce such a waiting time.

One method for reducing such a waiting period is to operate electrifier 17 once again following the transfer of a complete toner image before beginning the formation of a subsequent complete toner image. Electrifier 17 then deposits positive charge on the outer surface of photoconductor layer 16 to raise its surface potential to a relatively low value, typically 100 V, immediately after operation of cycle discharge means 33. The effect of such an application of positive charge to the outer surface of photoconductor layer 16 is to sweep the excess positive charges, or mobile hole charges, from the layer before charging that surface to the desired initial potential in the formation of the first toner subimage as part of providing the next printed image.

Although the present invention has been described with reference to preferred embodiments, workers skilled in the art will recognize that changes may be made in form and detail without departing from the spirit and scope of the invention.

What is claimed is:

1. A method for repeated electrical charging of a photoconductor layer on an electrical conductor provided at least as part of an exterior of a drum so that at least portions of an outer surface of said photoconductor layer are brought substantially to a selected initial surface potential after each of selected ones of such chargings, said method comprising:

charging said photoconductor layer outer surface to said initial surface potential through depositing electrical charge substantially uniformly over at least a part thereof as said drum rotates about an axis of rotation thereof;

directing a discharge electromagnetic radiation beam onto a first set of selected locations on said photoconductor layer outer surface, as previously charged, of sufficient intensity to thereby discharge portions of said photoconductor layer adjacent said first set of selected locations therein;

providing a first toner at said photoconductor layer outer surface with portions of said first toner remaining at locations on said photoconductor layer outer surface determined by which portions of said photoconductor layer have been discharged by said discharge electromagnetic radiation beam;

providing first erasure electromagnetic radiation on said photoconductor layer outer surface both at locations free of said first toner and at locations where said first toner is present through said first toner being capable of transmitting therethrough a substantial portion of said first erasure electromagnetic radiation, said first erasure electromagnetic radiation having wavelengths in a first spectral distribution;

transferring substantially all of said portions of first toner from said photoconductor layer outer surface to a transfer means; and providing termination electromagnetic radiation on said photoconductor layer outer surface, said termination electromagnetic radiation having wavelengths in a termination spectral distribution substantially all of which are shorter than those wavelengths contained in said first spectral distribution.

2. The method of claim 1 wherein said providing of said first erasure electromagnetic radiation is followed by:

charging again said photoconductor layer outer surface to said initial surface potential through depositing electrical charge substantially uniformly over at least a part thereof as said drum rotates about an axis of rotation thereof;

directing a discharge electromagnetic radiation beam onto a second set of selected locations on said photoconductor layer outer surface, as last previously charged, of sufficient intensity to thereby discharge portions of said photoconductor layer adjacent said second set of selected locations therein;

providing a second toner at said photoconductor layer outer surface with portions of said second toner remaining at locations on said photoconductor layer outer surface determined by which portions of said photoconductor layer have been discharged by said discharge electromagnetic radiation beam;

providing second erasure electromagnetic radiation on said photoconductor layer outer surface both at locations free of said first and second toners and at locations where either of said first and second toners are present through said first and second toners being capable of transmitting therethrough a substantial portion of said second erasure electromagnetic radiation, said second erasure electromagnetic radiation having wavelengths in a second spectral distribution substantially all of which are longer than those wavelengths contained in said termination spectral distribution; and transferring substantially all of said portions of said first and second toners from said photoconductor layer outer surface to said transfer means.

3. The method of claim 1 wherein said providing of said first erasure electromagnetic radiation is followed by:

charging again said photoconductor layer outer surface to said initial surface potential through depositing electrical charge substantially uniformly over at least a part thereof as said drum rotates about an axis of rotation thereof;

directing a discharge electromagnetic radiation beam onto a second set of selected locations on said photoconductor layer outer surface, as last previously charged, of sufficient intensity to thereby discharge portions of said photoconductor layer adjacent said second set of selected locations therein;

providing a second toner at said photoconductor layer outer surface with portions of said second toner remaining at locations on said photoconductor layer outer surface determined by which portions of said photoconductor layer have been discharged by said discharge electromagnetic radiation beam; and transferring substantially all of said portions of said first and second toners from said photoconductor layer outer surface to said transfer means.

4. The method of claim 1 wherein wavelengths in said discharge electromagnet radiation beam are substantially all common to wavelengths in said first spectral distribution.

5. The method of claim 1 wherein said portions of first toner remain at said first set of selected locations of said photoconductor layer outer surface before said transferring thereof.

6. The method of claim 1 wherein said providing of termination electromagnetic radiation is followed by charging said photoconductor layer outer surface to a termination surface potential which is less than said initial surface potential through depositing electrical charge substantially uniformly over at least a portion of said photoconductor layer outer surface as said drum rotates about its said axis of rotation.

7. The method of claim 1 wherein said first spectral distribution substantially contains wavelengths which are longer than those in said visible spectrum.

8. The method of claim 1 wherein said termination spectral distribution substantially contains wavelengths which are shorter than those in said visible spectrum.

9. The method of claim 2 wherein said providing of said second erasure electromagnetic radiation is followed by:

charging again said photoconductor layer outer surface to said initial surface potential through depositing electrical charge substantially uniformly over at least a part thereof as said drum rotates about an axis of rotation thereof;

directing a discharge electromagnetic radiation beam onto a third set of selected locations on said photoconductor layer outer surface, as last previously charged, of sufficient intensity to thereby discharge portions of said photoconductor layer adjacent said third set of selected locations therein;

providing a third toner at said photoconductor layer outer surface with portions of said third toner remaining at locations on said photoconductor layer outer surface determined by which portions of said photoconductor layer have been discharged by said discharge electromagnetic radiation beam;

providing third erasure electromagnetic radiation on said photoconductor layer outer surface both at locations free of said first, second and third toners and at locations where any of said first, second and third toners are present through said first, second and third toners being capable of transmitting therethrough a substantial portion of said third erasure electromagnetic radiation, said third erasure electromagnetic radiation having wavelengths in a third spectral distribution substantially all of which are longer than those wavelengths contained in said termination spectral distribution; and transferring substantially all of said portions of said first, second and third toners from said photoconductor layer outer surface to said transfer means.

10. The method of claim 2 wherein said providing of said second erasure electromagnetic radiation is followed by:

charging again said photoconductor layer outer surface to said initial surface potential through depositing electrical charge substantially uniformly over at least a part thereof as said drum rotates about an axis of rotation thereof;

directing a discharge electromagnetic radiation beam onto a third set of selected locations on said photoconductor layer outer surface, as last previously charged, of sufficient intensity to thereby discharge portions of said photoconductor layer adjacent said third set of selected locations therein;

providing a third toner at said photoconductor layer outer surface with portions of said third toner remaining at locations on said photoconductor layer outer surface determined by which portions of said photoconductor layer have been discharged by said discharge electromagnetic radiation beam; and transferring substantially all of said portions of said first, second and third toners from said photoconductor layer outer surface to said transfer means.

11. The method of claim 2 wherein said portions of said first toner remain at said first set of selected locations of said photoconductor layer outer surface and said portions of second toner remain at said second set of selected locations of said photoconductor layer outer surface before said transferring thereof.

12. The method of claim 2 wherein said providing of termination electromagnetic radiation is followed by charging said photoconductor layer outer surface to a termination surface potential which is less than said initial surface potential through depositing electrical charge substantially uniformly over at least a portion of said photoconductor layer outer surface as said drum rotates about its said axis of rotation.

13. The method of claim 3 wherein said portions of said first toner remain at said first set of selected locations of said photoconductor layer outer surface and said portions of second toner remain at said second set of selected locations of said photoconductor layer outer surface before said transferring thereof.

14. The method of claim 3 wherein said providing of termination electromagnetic radiation is followed by charging said photoconductor layer outer surface to a termination surface potential which is less than said initial surface potential through depositing electrical charge substantially uniformly over at least a portion of said photoconductor layer outer surface as said drum rotates about its said axis of rotation.

15. The method of claim 9 wherein said providing of said third erasure electromagnetic radiation is followed by:

charging again said photoconductor layer outer surface to said initial surface potential through depositing electrical charge substantially uniformly over at least a part thereof as said drum rotates about an axis of rotation thereof;

directing a discharge electromagnetic radiation beam onto a fourth set of selected locations on said photoconductor layer outer surface, as last previously charged, of sufficient intensity to thereby discharge portions of said photoconductor layer adjacent said fourth set of selected locations therein;

providing a fourth toner at said photoconductor layer outer surface with portions of said fourth toner remaining at locations on said photoconductor layer outer surface determined by which portions of said photoconductor layer have been discharged by said discharge electromagnetic radiation beam;

providing fourth erasure electromagnetic radiation on said photoconductor layer outer surface both at locations free of said first, second, third and fourth toners and at locations where any of said first, second, third and fourth toners are present through said first, second, third and fourth toners being capable of transmitting therethrough a substantial portion of said fourth erasure electromagnetic radiation, said fourth erasure electromagnetic radiation having wavelengths in a fourth spectral distribution substantially all of which are longer than those wavelengths contained in said termination spectral distribution; and transferring substantially all of said portions of said first, second, third and fourth toners from said photoconductor layer outer surface to said transfer means.

16. The method of claim 9 wherein said providing of said third erasure electromagnetic radiation is followed by:

charging again said photoconductor layer outer surface to said initial surface potential through depositing electrical charge substantially uniformly over at least a part thereof as said drum rotates about an axis of rotation thereof;

directing a discharge electromagnetic radiation beam onto a fourth set of selected locations on said photoconductor layer outer surface, as last previously charged, of sufficient intensity to thereby discharge portions of said photoconductor layer adjacent said fourth set of selected locations therein;

providing a fourth toner at said photoconductor layer outer surface with portions of said fourth toner remaining at locations on said photoconductor layer outer surface determined by which portions of said photoconductor layer have been discharged by said discharge electromagnetic radiation beam; and transferring substantially all of said portions of said first, second, third and fourth toners from said photoconductor layer outer surface to said transfer means.

17. The method of claim 10 wherein said third toner is incapable of transmitting therethrough a significant portion of said first and second erasure electromagnetic radiation.

18. A repeatable photoconductor charging system for repeatably electrically charging a photoconductor layer on an electrical conductor provided at least as part of an exterior of a drum so that at least portions of an outer surface of said photoconductor layer are brought substantially to a selected initial surface potential after each of selected ones of such chargings, said charging system comprising:

a charging means capable of charging said photoconductor layer outer surface to said initial surface potential through depositing electrical charge substantially uniformly over at least a part thereof as said drum rotates about an axis of rotation thereof;

a selective discharge means capable of directing a discharge electromagnetic radiation beam onto selected sets of selected locations on said photoconductor layer outer surface, as previously charged, of sufficient intensity to thereby discharge portions of said photoconductor layer adjacent said selected sets of selected locations therein;

a toner provision means capable of providing selected different toners at said photoconductor layer outer surface with portions of such selected said toners remaining at locations on said photoconductor layer outer surface determined by which portions of said photoconductor layer have been correspondingly discharged by a said discharge electromagnetic radiation beam;

an intermediate erasure means capable of providing erasure electromagnetic radiation on said photoconductor layer outer surface both at locations free of said toners and at locations where at least one of said toners is present through said toners being capable of transmitting therethrough a substantial portion of said erasure electromagnetic radiation, said erasure electromagnetic radiation having wavelengths in a first spectral distribution;

a transfer means capable of transferring substantially all of said portions of said toners remaining on said photoconductor layer outer surface to a transfer means; and a termination erasure means capable of providing termination electromagnetic radiation on said photoconductor layer outer surface, said termination electromagnetic radiation having wavelengths in a termination spectral distribution substantially all of which are shorter than those wavelengths contained in said first spectral distribution.

19. The apparatus of claim 18 wherein wavelengths in said discharge electromagnetic radiation beam are substantially all common to wavelengths in said first spectral distribution.

20. The apparatus of claim 18 wherein said portions of said toners remain at corresponding said selected set of selected locations of said photoconductor layer outer surface before said transferring thereof.

21. The apparatus of claim 18 wherein there is further provided a termination charging means capable of charging said photoconductor layer outer surface to a termination surface potential after termination electromagnetic radiation has been deposited thereon through depositing electrical charge substantially uniformly over at least a portion of said photoconductor layer outer surface as said drum rotates about its said axis of rotation, said termination surface potential being less than said initial surface potential.

* * * * *

UNITED STATES PATENT AND TRADEMARK OFFICE

CERTIFICATE OF CORRECTION

PATENT NO. : 5,083,163

DATED : January 21, 1992

INVENTOR(S) : David E. Brown, Gregory L. Zwadio

It is certified that error appears in the above-identified patent and that said Letters Patent is hereby corrected as shown below:

On the title page, under item [56] References Cited, after the "U.S. PATENT DOCUMENTS" insert the following:

-- OTHER PUBLICATIONS

"Red or IR Light Source Induced Fatigue Effects of Se-Based Photoconductors in Non-Impact Printers", H. Pinsler et al, Journal of Imaging Technology, Vol. 16, No. 2, April 1990, --.

Col 14, line 32, delete "set", insert "sets".

Signed and Sealed this

Fourth Day of May, 1993

*Attest:*

Michael K. Kirk

MICHAEL K. KIRK

*Attesting Officer*

*Acting Commissioner of Patents and Trademarks*